US006447267B1

(12) United States Patent
Varney et al.

(10) Patent No.: US 6,447,267 B1
(45) Date of Patent: Sep. 10, 2002

(54) LOCOMOTIVE AIR COMPRESSOR WITH MOTOR SUPPORTED BY OUTSIDE BEARING

(75) Inventors: James Varney, North Huntingdon; Brian L. Cunkelman, Blairsville; Walter E. Goettel, Monogahela, all of PA (US)

(73) Assignee: Wabtec Corporation, Wilmerding, PA (US)

( * ) Notice: Subject to any disclaimer, the term of this patent is extended or adjusted under 35 U.S.C. 154(b) by 0 days.

(21) Appl. No.: 09/593,559

(22) Filed: Jun. 14, 2000

(51) Int. Cl.[7] ..... F04B 35/04; F04B 39/06
(52) U.S. Cl. ..... 417/360; 417/372; 417/415
(58) Field of Search ..... 310/90, 91, 258; 417/248, 360, 415, 372

(56) References Cited

U.S. PATENT DOCUMENTS 860,826 A * 7/1907 Reavell ..... 417/248
1,293,573 A * 2/1919 Swartz
1,580,587 A * 4/1926 Daniel
1,991,761 A * 2/1935 McHugh ..... 417/360
2,440,897 A * 5/1948 Hammarstrom
2,665,054 A * 1/1954 Fischer ..... 417/360
4,170,058 A * 10/1979 Leffler ..... 310/90
4,900,224 A * 2/1990 Timperi et al. ..... 417/360

* cited by examiner

*Primary Examiner*—Michael Koczo
(74) *Attorney, Agent, or Firm*—James Ray & Associates

(57) ABSTRACT

The present invention provides an assembly for supporting a rotatable shaft member driven by a motor. The assembly comprises a base member, an upright support member connected to the base member and a bearing member mounted on the upright support member Such bearing member is connectable with the rotatable shaft member for supporting such rotatable shaft member thereby reducing extraneous vertical and horizontal movement of such rotatable shaft member while permitting such rotatable shaft member to rotate freely.

17 Claims, 4 Drawing Sheets

LOCOMOTIVE AIR COMPRESSOR WITH MOTOR SUPPORTED BY OUTSIDE BEARING

CROSS REFERENCE TO RELATED APPLICATIONS

The invention taught in this patent application is closely related to the invention taught in the following co-pending patent application, LOCOMOTIVE AIR COMPRESSOR WITH AN ELECTRIC MOTOR SUPPORTED BY AN EXTERNAL BEARING, Ser. No. 09/593,558 which is being filed concurrently herewith. These patent applications are assigned to the same assignee and the teachings therein are incorporated into this application by reference thereto.

FIELD OF INVENTION

The present invention relates, in general, to an air-cooled multi-cylinder, two-stage air compressor and motor combination for a railway locomotive and, more particularly, the present invention relates to a crankshaft of such air compressor driven by such motor being supported by an outside bearing.

BACKGROUND OF THE INVENTION

It is well known that multi-cylinder air compressors are used on freight and passenger locomotives to supply compressed air to the operating and control equipment of a railway air brake system. Many of these prior art air compressors have a pair of low pressure cylinders and a high pressure cylinder mounted on and supported by a crankcase in the usual manner and contain pistons which are actuated by connecting rods driven by a rotary crankshaft. One end of the crankshaft is coupled with and driven by a suitable rotatable prime mover, such as an electric motor. The other end of the crankshaft is keyed and threadably attached by a locknut to the hub and wheel of a cooling fan assembly.

There are advantages of having the compressor directly driving the cooling fan. When the demand and speed of the air compressor increase, the speed and cooling capacity of the fan is proportionally increased. The fan can only stop turning when the compressor stops working or ceases to rotate. It has been found that the use of a separate electric motor for driving the cooling fan is unreliable since failure of the motor would result in the loss of the cooling effect and could allow the temperature of the rotating compressor to rise to dangerously high levels which could cause deterioration of the lubricating oil and could result in seizure of the air compressor.

The crankshaft driven by the electric motor does not, in prior art, have any support on the motor end of the shaft. This is the opposite end of the shaft from the fan. As the shaft rotates, in time, it may tend to vibrate and may possibly wobble. Any movement of the shaft, other than the rotatable movement which it is designed to have, may cause problems with the motor.

Proper operation requires that there be a space between th[0085] stator and the rotating portion of the motor. This space must be maintained. If the rotor contacts or rubs against the stator, problems with the motor may occur. On the other hand it is also important to keep the space between the stator and rotor to a minimum because as the space increases there is a loss of efficiency and of the power of the motor. Thus, the space is necessary but it must be kept as small as possible. When the shaft vibrates or wobbles it may cause the rotor to rub against the stator and, thus, adversely affect the motor.

SUMMARY OF THE INVENTION

The present-invention provides an assembly for supporting a rotatable shaft member driven by a motor. The assembly comprises a base member, an upright support member connected to the base member and a bearing member mounted on the upright support member. Such bearing member is connectable with the rotatable shaft member for supporting such rotatable shaft member thereby reducing extraneous vertical and horizontal movement of such rotatable shaft member while permitting such rotatable shaft member to rotate freely.

A second embodiment of the invention provides that in combination with a multi-cylinder two-stage air compressor in which an electric motor is used to drive a rotatable shaft member of said air compressor, there is an externally mounted assembly for supporting the rotatable shaft member of the air compressor. Such externally mounted assembly comprises a base member, an upright support member connected to the base member and a bearing member mounted on the upright support member. Such bearing member is connectable to the rotatable shaft member for securing the rotatable shaft member thereby reducing extraneous vertical and horizontal movement of the rotatable shaft member while permitting such rotatable shaft member to rotate freely.

OBJECTS OF THE INVENTION

It is, therefore, one of the primary objects of the present invention to provide a support for the crankshaft external to the motor housing in an air compressor/motor combination so as to reduce any vibration of the shaft.

It is also an object of the present invention to provide an outside support for the crankshaft in an air compressor/motor combination so as to reduce the possibility of the rotor rubbing against the stator.

An additional object of the present invention is to provide a support for the crankshaft in an air compressor/motor combination that is mounted on the base of the compressor unit.

These and various other objects and advantages of this invention will become apparent after a full reading of the following detailed description, particularly, when read in conjunction with the attached drawings as described below and the appended claims.

Figure 1:
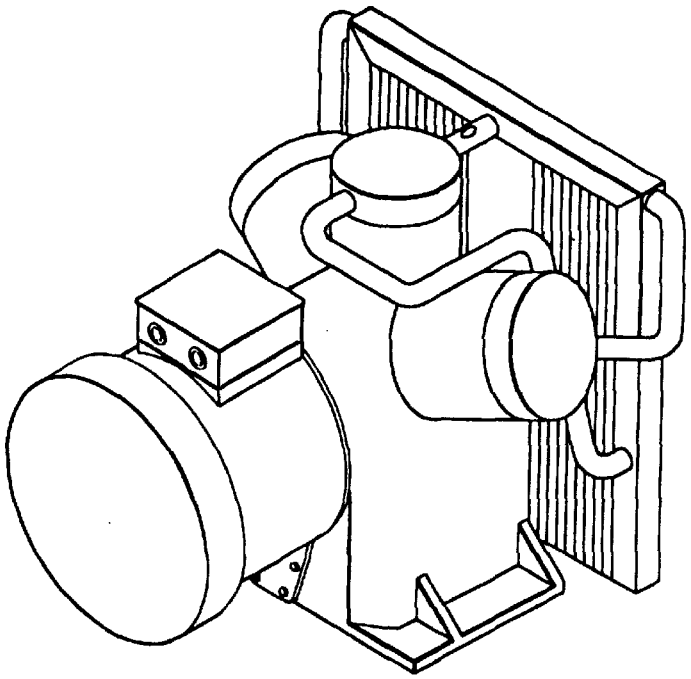
FIG. 1 PRIOR ART
FIG. 1 is an axonometric prior art drawing of a multi-cylinder, two stage air compressor.

BRIEF DESCRIPTION OF THE PRESENTLY PREFERRED AND ALTERNATE EMBODIMENTS OF THE INVENTION

Prior to proceeding with the more detailed description of the present invention it should be noted that, for the sake of clarity, identical components which have identical functions have been designated by identical reference numerals throughout the several views illustrated in the drawings.

Figure 2:
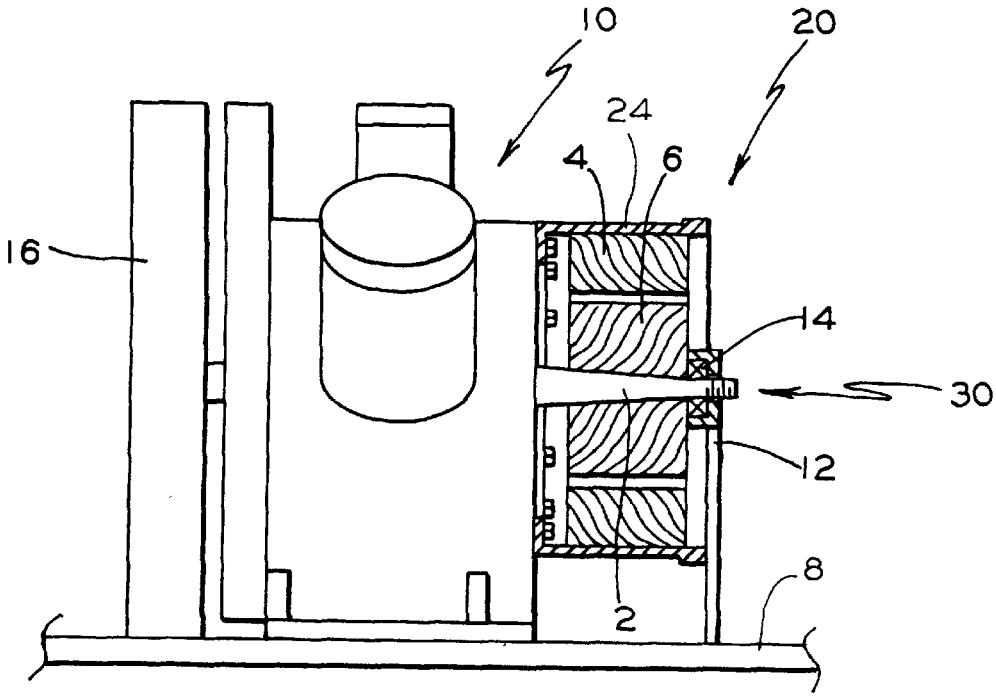
FIG. 2 is a block schematic diagram of an embodiment of the invention in combination with a multi-cylinder, two stage air compressor of the type shown in FIG. 1.

Reference is now made to FIG. 2. Illustrated therein is a block diagram of the present invention in combination with a multi-cylinder, two stage air compressor, generally designated as 10, coupled with an electric motor, generally designated as 20. Such multi-cylinder, two stage air compressor 10 contain pistons which are actuated by connecting rods driven by a rotary crankshaft 2. One end of the crankshaft 2 is to the hub and wheel of a cooling fan assembly 16. The other end of the crankshaft 2 is driven by an electric motor 20. In time the crankshaft 2 as it rotates may tend to vibrate or wobble. Any movement of the crankshaft 2 other than the rotatable movement which it is designed to have can create problems.

Proper operation of the motor requires that there be a space between the stator 4 and the rotor 6, which is the rotating portion of the motor. This space must be maintained. If rotor 6 comes into contact with or rubs against the stator 4, problems with the motor 20 may occur. It is also important that this space be kept to a minimum because as the space increases there is a loss of efficiency and of the power of the motor.

Figure 5:
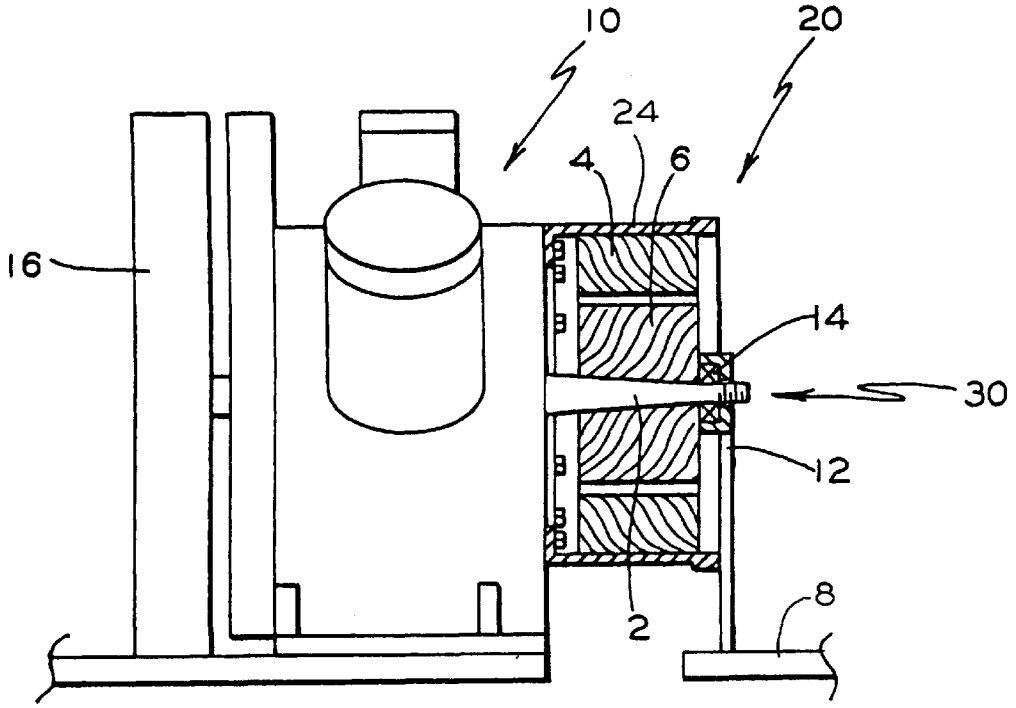
FIG. 5 is a block schematic diagram of an embodiment of the invention in combination with a multi-cylinder, two stage air compressor of the type shown in FIG. 1 in which the base member of the air compressor and the base member for the support member are separate bases.
Figure 6:
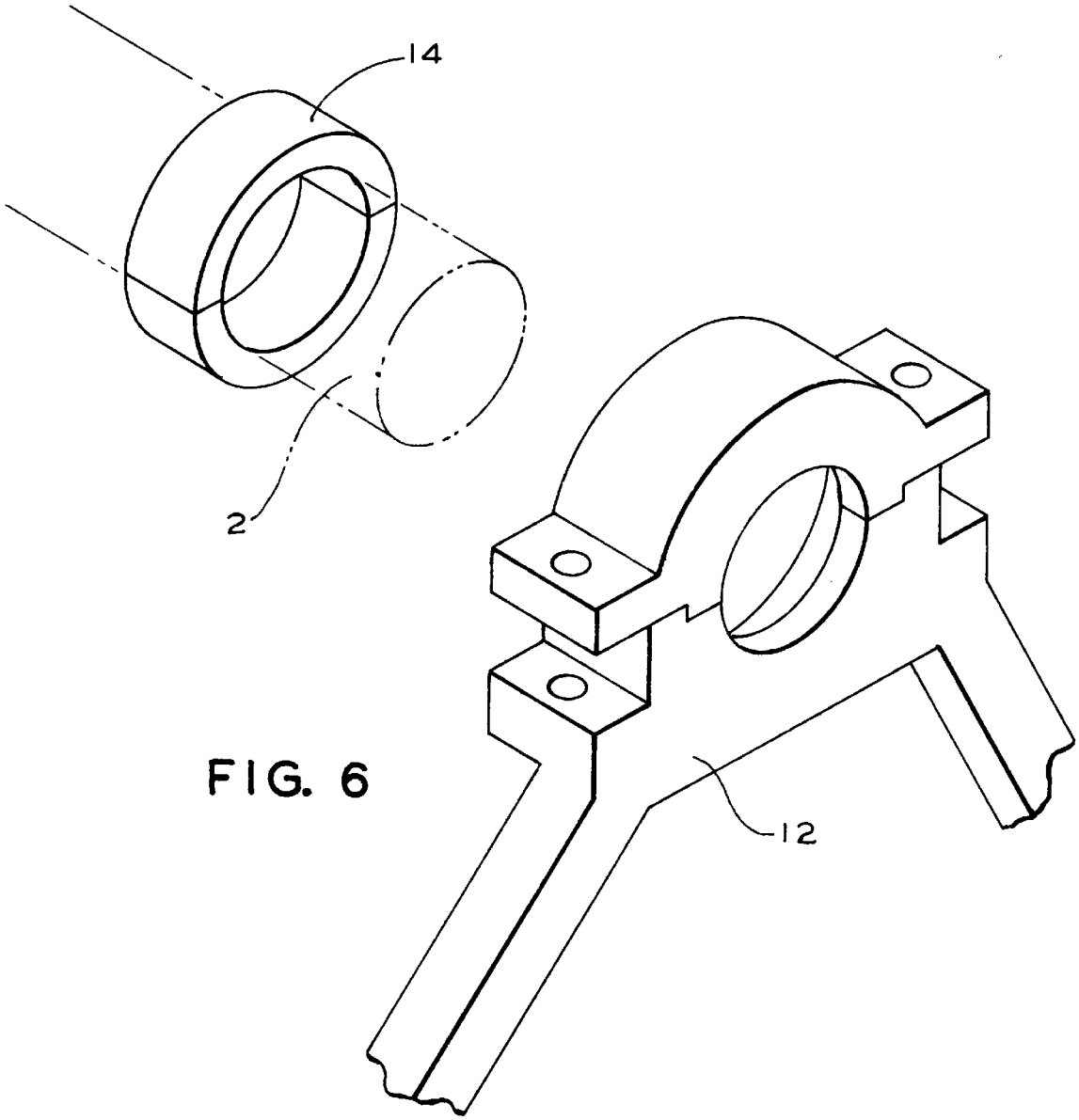
FIG. 6 is an axonometric drawing of a split type bearing according to an embodiment of the invention.

As mentioned previously such base 8 may be incorporated with the base of the compressor, as is evident in FIG. 2, or it may remain as a separate portion as is seen in FIG. 5. Such external mount 30 may be included in new compressor assemblies or it may be retrofitted into air compressor units that are presently in use.

The present invention provides an external support, generally designated 30, to support the crankshaft 2 and thus prevent or at least minimize any extraneous vertical or horizontal movement of the crankshaft 2. The external mount comprises a base 8. As pictured in FIG. 2 the base 8 f forms a base upon which the compressor 10 sits. However, the base 8 may be of various lengths and may not include a portion under such compressor 20. An upright support member 12 is connected to the base 8. There is a bearing member 14 mounted on such upright support member 12. Such bearing member 14 is connectable with the crankshaft 2 of such air compressor 10. Such bearing member 14 and such upright support member 12 supports the crankshaft thereby minimizing any extraneous movement of the crankshaft 2. Since the bearing member 14 freely rotates it does not impede any rotatable movement of the crankshaft 2. In an embodiment of the invention such bearing member 14 is a split type bearing. In another embodiment of the invention the bearing member 14 is connected to an outer end of such crankshaft 2.

The upright support member 12 may be connected to the motor cover 22 which overlaps the motor housing 24 that is presently used to enclose such motor 20 by modifying such motor cover 22 such that the bearing member 14 can secure the crankshaft 2. However, it is within the scope of the invention that such upright support member 12 may be used to replace the present motor cover 22 of such motor 20.

As mentioned previously such base 8 may be incorporated with the base of the compressor or it may remain as a separate portion. Such external mount 30 may be included in new compressor assemblies and it may be retrofitted into air compressor units that are presently in use.

Figure 3:
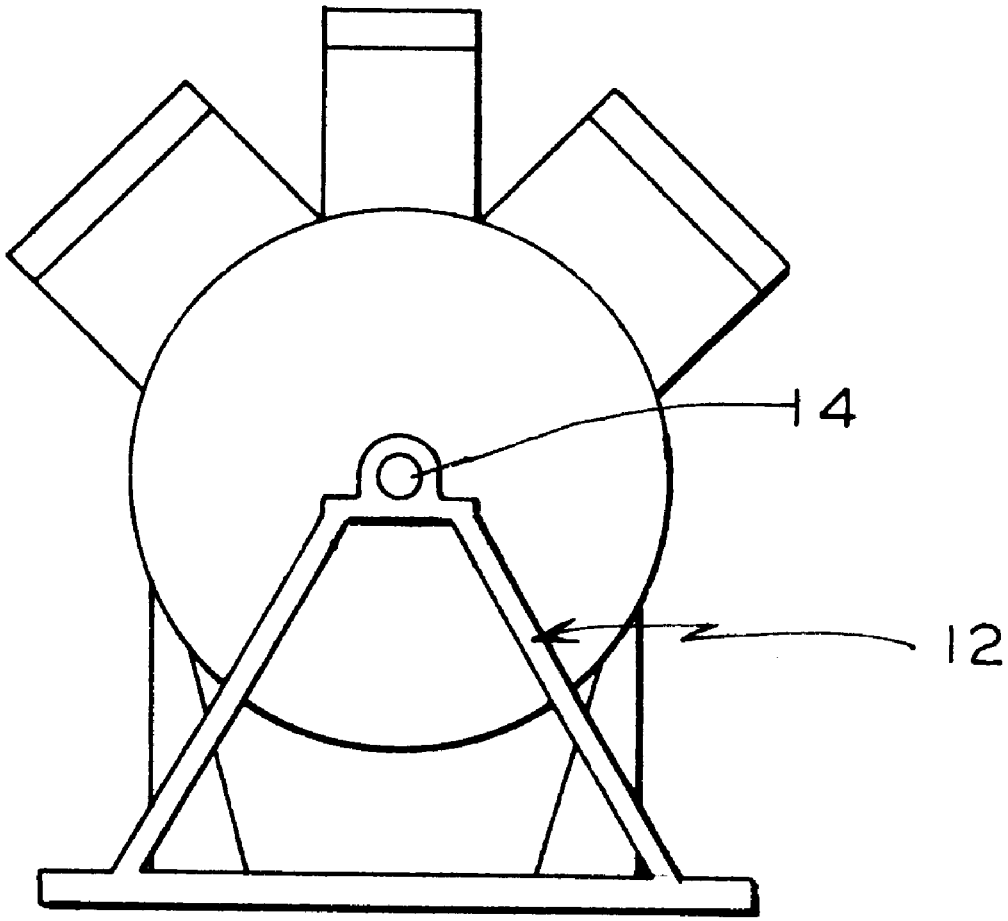
FIG. 3 is schematic diagram of a second embodiment of the invention showing an upright support member as an A-frame.
Figure 4:
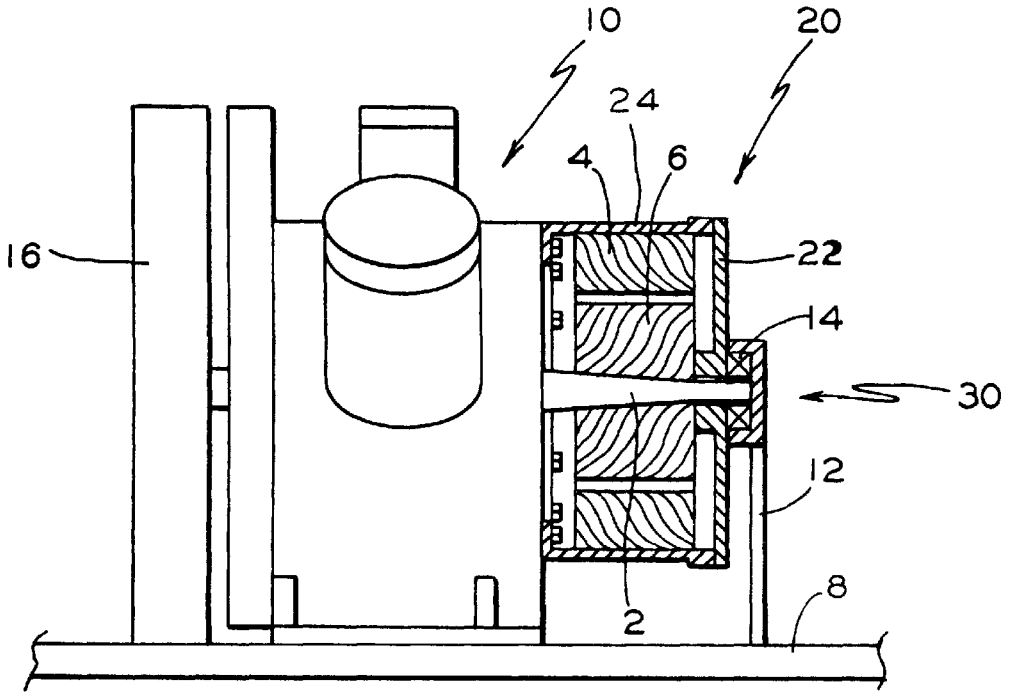
FIG. 4 is a block schematic diagram of an embodiment of the invention in combination with a multi-cylinder, two stage air compressor of the type shown in FIG. 1 in which the base member of the air compressor includes the base member for the support member and showing the motor cover and motor housing in relation to the present invention.

Illustrated in FIG. 3 is another embodiment of the invention in which the upright support member 12 is in the form of an A-frame. In this embodiment such bearing member 14 is mounted on the apex of the upright support member 12.

While both the presently preferred and a number of alternative embodiments of the present invention have been described in detail above it should be understood that various other adaptations and modifications of the present invention can be envisioned by those persons who are skilled in the relevant art of air compressor systems without departing from either the spirit of the invention or the scope of the appended claims.

We claim:

1. An assembly for supporting one end of a rotatable shaft member of a compressor driven by a motor, said assembly comprising:

(a) a base member;

(b) a support member connected to and extending substantially vertical from said base member and being substantially perpendicular to a longitudinal and horizontally disposed axis of said rotatable shaft member; and (d) a bearing member carried by said support member having an outer surface engageable with an inner surface of said support member and an inner surface engageable with an outer surface of such rotatable shaft member and connectable with such one end of such rotatable shaft member that is opposite an end of such rotatable shaft member connected to a hub and wheel of a cooling fan of such compressor for supporting such rotatable shaft member in a manner so as to thereby reduce extraneous vertical and horizontal movement of such rotatable shaft member while permitting such rotatable shaft member to rotate freely.

2. An assembly for supporting one end of a rotatable shaft member of a compressor driven by a motor, according to claim 1, wherein said base member is disposed as part of a base of such compressor connected to said motor and said assembly.

3. An assembly for supporting one end of a rotatable shaft member of a compressor driven by a motor, according to claim 1, wherein said base member of said assembly is a separate base for said assembly and is independent of a base of such compressor.

4. An assembly for supporting one end of a rotatable shaft member driven by a motor, according to claim 1, wherein said bearing member is a split type bearing.

5. An assembly for supporting one end of a rotatable shaft member driven by a motor, according to claim 1, wherein said support member is an A-frame.

6. An assembly for supporting one end of a rotatable shaft member driven by a motor, according to claim 5, wherein said bearing member is mounted on an apex of said A-frame support member.

7. An assembly for supporting one end of a rotatable shaft member driven by a motor, according to claim 1, wherein a first end of said support member is connected to said base member and a portion of said upright support member is connected to a motor cover of a motor housing.

8. An assembly for supporting one end of a rotatable shaft member driven by a motor, according to claim 7, wherein said first end of said support member is connected to said base member and a radially opposed second end is connected to such motor cover of such motor housing.

9. In combination with a multi-cylinder two-stage air compressor in which an electric motor drives a rotatable shaft member of said air compressor, the improvement comprising an externally mounted assembly for supporting one end of said rotatable shaft member of said air compressor, said externally mounted assembly including:

(a) a base member;

(b) a support member connected to and extending substantially vertical from said base member and being substantially perpendicular to a longitudinal and horizontally disposed axis of said rotatable shaft member; and (d) a bearing member carried by said support member having an outer surface engageable with an inner surface of said support member and an inner surface engageable with an outer surface of said rotatable shaft and connectable with said one end of said rotatable shaft member for supporting said rotatable shaft member in a manner so as to thereby reduce extraneous vertical and horizontal movement of said rotatable shaft member while permitting said rotatable shaft member to rotate freely.

10. The combination, according to claim 9, wherein said base member is one of being incorporated as a single base for said air compressor and said externally mounted assembly and as a separate base for said externally mounted assembly.

11. The combination, according to claim 10, wherein said base member of said externally mounted assembly is a separate base for said externally mounted assembly.

12. The combination, according to claim 9, wherein said bearing member is a split type bearing.

13. The combination, according to claim 12, wherein said bearing member is connected to said one end of said rotatable shaft member that is opposite an end of said rotatable shaft member connected to a hub and wheel of a cooling fan of said air compressor.

14. The combination, according to claim 9, wherein said support member is an A-frame.

15. The combination, according to claim 14, wherein said bearing member is mounted on an apex of said A-frame upright support member.

16. The combination, according to claim 9, wherein a first end of said upright support member is connected to said base member and a portion of said upright support member is connected to a motor cover of a motor housing.

17. The combination, according to claim 16, wherein said first end of said upright support member is connected to said base member and a radially opposed second end is connected to said motor cover of said motor housing.

* * * * *